US005635798A

United States Patent [19]

Ogura et al.

[11] Patent Number: 5,635,798

[45] Date of Patent: Jun. 3, 1997

[54] MAGNETRON WITH REDUCED DARK CURRENT

[75] Inventors: Toshio Ogura; Seiji Kitakaze, both of Mobara, Japan

[73] Assignees: Hitachi, Ltd., Tokyo; Hitachi Electronic Devices Co., Ltd., Chiba-ken, both of Japan

[21] Appl. No.: 360,967

[22] Filed: Dec. 21, 1994

[30] Foreign Application Priority Data

Dec. 24, 1993 [JP] Japan ..... 5-326832
Dec. 24, 1993 [JP] Japan ..... 5-326833

[51] Int. Cl.[6] ..... H01J 25/50; H01J 23/10

[52] U.S. Cl. ..... 315/39.71; 315/39.51

[58] Field of Search ..... 315/39.71, 39.51

[56] References Cited

U.S. PATENT DOCUMENTS

| | | | |
|---|---|---|---|
| 3,392,308 | 7/1968 | Cook | 315/39.71 X |
| 3,916,247 | 10/1975 | Koinuma et al. | 315/39.71 |
| 3,987,333 | 10/1976 | Nakada et al. | 315/39.71 |
| 4,048,542 | 9/1977 | Miura | 315/39.71 |
| 5,049,782 | 9/1991 | Aiga et al. | 315/39.51 |

FOREIGN PATENT DOCUMENTS

| | | |
|---|---|---|
| 2-30036 | 1/1990 | Japan . |
| 4-223026 | 8/1992 | Japan . |
| 2-276136 | 10/1992 | Japan . |
| 62-262345 | 10/1992 | Japan . |
| 4-296429 | 10/1992 | Japan . |
| 5-6739 | 10/1992 | Japan . |
| 6-5211 | 1/1994 | Japan . |

*Primary Examiner*—Benny T. Lee
*Attorney, Agent, or Firm*—Antonelli, Terry, Stout & Kraus, LLP

[57] ABSTRACT

A magnetron preventing increases of dark current by making an axial static magnetic field on a plane containing an inner surface of an end shield on the microwave output port side in the interaction space different from the static magnetic field on a plane containing an inner surface of the end shield on the cathode stem side. The interaction-space-side axial end of a peripheral portion of the end shield associated with the weaker static magnetic field is displaced a predetermined distance axially toward the interaction space from the axial ends of the magnetron vanes. In one embodiment, the axial static magnetic field on a plane containing an inner surface of the end shield on the microwave output port side in the interaction space is made stronger than the static magnetic field on a plane containing an inner surface of the end shield on the cathode stem side. This compensates for eccentricity of the axis of the cathode with respect to the axis of the anode vanes. Such eccentricity is greater on the microwave output port side remote from the cathode stem.

20 Claims, 10 Drawing Sheets

MAGNETRON WITH REDUCED DARK CURRENT

BACKGROUND OF THE INVENTION

Field of the Invention

The present invention relates to a magnetron with reduced dark current. More particularly, it concerns a magnetron that can suppress increases of dark current to raise the oscillation efficiency thereof, with little noise radiated out, for use in a microwave oven. By "noise" is meant microwaves outside the frequency range of 2400 to 2500 MHz, including side lobes and spurious signals.

FIG. 6 depicts a side view cross-sectioned in an axial direction of a tube illustrating an example of a prior magnetron. The example has cavity resonators formed of vanes 3 extended radially inwardly from an anode cylinder 2 made chiefly of copper. A cathode 1 is positioned at the center of the anode cylinder 2. There is formed an annular interaction space around the cathode 1. The anode cylinder 2 and the vanes 3 are integrated together by way of hobbing or are fabricated individually before being brazed together. The cathode 1 is usually made of helically coiled thoriated-tungsten wire. Both ends of the cathode 1 are connected and held with end shields 12 and 13, respectively. An antenna 5 is connected with a microwave output port 8 to withdraw the microwave energy out from one of the vanes 3. Pole pieces 4 are attached to the upper and lower ends of the anode cylinder 2, respectively, to efficiently concentrate lines of magnetic force into the interaction space formed between the tips of the vanes 3 and the cathode 1. The ends on the interaction space side of the peripheral portions of the end shields 12 and 13 are displaced along the tube axis from the axial ends of the vanes 3 near the cathode 1 toward the outside of the interaction space.

An axial static magnetic field is formed in the interaction space defined by annular permanent magnets 6 which are short in axial length and which are provided at the top and the bottom of the anode cylinder 2, respectively, as a source of a magnetomotive force, a yoke 7, which enclose the tube and is in contact with the outsides of the permanent magnets 6 to form an external magnetic circuit, and the pole pieces 4, each of which has a peripheral portion sandwiched between the adjacent end of the anode cylinder 2 and the respective adjacent permanent magnet 6 and has an inner portion extending close to the end of the interaction space. A vacuum envelope, including the anode cylinder 2, is grounded for safety. The cathode 1 has a high negative d-c potential applied thereto. Electrons are attracted from the cathode 1 toward tips of the vanes 3 which are at ground potential, and at the same time are acted upon by the axial static magnetic field in the interaction space and have a force exerted thereon in a direction perpendicular to the direction of the magnetic field and the motion thereof, and some electrons are turned back toward the cathode 1 after whirling near the tips of the vanes 3 circumferentially about the cathode.

This causes a high-density area and a low-density area of electrons to be formed in the interaction space. An electron cloud of the high density whirls at a high speed in the interaction space to excite microwave oscillations in a group of cavity resonators formed by the anode cylinder 2 and the adjacent vanes. Of the electric oscillations in the group of cavity resonators, the so-called $\pi$ mode of oscillation having a reversed phase between adjacent cavities is strongest and stablest. To add further stability of the oscillation in the $\pi$ mode, an inner strap ring 10 and an outer strap ring 11 for connecting alternate ones of the vanes 3 are contained in grooves at the axial ends of the vanes for the purpose of tying together points at the same potential (same phase). The microwave energy is withdrawn through the microwave output port 8 by the antenna 5 mounted at the end of one of the vanes into a microwave oven for heating food, for example. Note that the cathode 1 is supported by cathode stem 9 through heater-current-feeding wires.

Such magnetrons are mostly used for microwave ovens at present. Beside characteristic performance, an important factor of home appliances is low price. For this purpose, magnetrons for use in microwave ovens have been designed to lower their cost in a variety of ways. The prior magnetron described above has strap rings at the ends of the vanes on both the microwave output port 8 side and the cathode stem side. If the strap rings can be reduced to only one at one of the ends of the vanes, the number of manufacturing steps and parts cost can be decreased.

However, if a strap ring is provided only at one of the axial ends of the vanes and the other portions are left as they were, the resonance frequency of the cavity is made too high. This is caused by the fact that the electric capacitance between the inner and outer strap rings and the capacitance between a vane connected with one of the two strap rings and the other of the two strap rings are almost halved. A method of suppressing the increase of the resonance frequency is proposed in the Japanese Patent Laid-Open No. 4-223026. To electrically connect alternate ones of the vanes, the inner and outer strap rings are fitted in the grooves only at the ends of the vanes on the microwave output port 8 side at an equal interval from the tube axis, and also, each vane has an extended portion symmetrically projected toward the tips of the adjacent vanes and having surfaces in parallel with corresponding surfaces of an extended portion of the adjacent vanes, thereby compensating for reduction of the electric capacitance. Another method of suppressing the increase of the resonance frequency is to decrease the axial width of each vane so as to increase the inductance of the vane. If the two above-described methods are used together, the end of each vane on the cathode stem side has a level difference provided at a boundary between the extended portion and a portion adjoined with it to narrow the axial width of the portion of the vane other than the extended portion, thereby increasing the inductance of the portion of the vane other than the extended portion. Such a combined method can increase the inductance and the electric capacitance of the cavity resonator. Even when the strap rings are provided only at one of the axial ends of the vanes, therefore, the resonance frequency can be made the same as in the prior art. FIG. 7 (*a*) depicts a plan view illustrating the anode cylinder of the magnetron of the above-mentioned technique, and FIG. 7 (*b*) depicts a cross-sectional view illustrating the same anode cylinder. In FIGS. 7(*a*) and 7(*b*), reference numeral 31 denotes the extended portion of the vane 3, while reference numeral 3*a* is the groove for fitting in the strap ring, and reference numeral 3*b* is the level difference at the boundary between the extended portion and the portion adjoined with it. The vanes 3 and the anode cylinder 2 described above are integrally fabricated by way of hobbing. A groove (not marked) for mounting an end of the antenna has to be actually made only on a single vane. But, the grooves are formed in all the vanes as they are made at one time by a lathe.

Integral forming of the above-described anode cylinder of the magnetron by way of hobbing makes the shape of the hob somewhat complicated. But, as an amount of the material to be extruded at the center of the material blank is reduced, resistance to the hob is reduced, thereby making longer the service life of the hob.

SUMMARY OF THE INVENTION

When one uses the anode cylinder of the magnetron having the strap rings coupled therein for electrically connecting alternate ones of the plurality of vanes at the ends of the plurality of vanes only on the microwave output port side, side lobes in the frequency spectrum of a fundamental wave of the actual microwave oscillation are not sufficiently suppressed as shown in FIG. 9. The magnetron also produces conspicuous spurious signals. If the magnetron is used in a magnetron apparatus, such as a microwave oven, it has the disadvantage that too much noise is radiated out.

A microwave oven is required to use a microwave frequency of 2,450 MHz. Its allowable working range is 2,400 to 2,500 MHz. Leakage of waves beyond the allowable range is strictly regulated by statute. In view of the foregoing, it is an object of the present invention to suppress or reduce noises in a magnetron having strap rings only at one of the axial ends of vanes.

Another object of the present invention is to suppress increase in dark current due to eccentricity of a cathode and to raise oscillation efficiency of a magnetron.

In view of solving the foregoing problems of the prior arts, it is still another object of the present invention to provide a magnetron that can sufficiently suppress noises, particularly of frequencies beyond a range of 2,400 to 2,500 MHz, with strap rings fitted only at one of the axial ends of vanes. Still another object of the present invention is to provide a magnetron that can suppress increase in dark current and raise the oscillation efficiency thereof.

The foregoing objects are accomplished in accordance with aspects of the present invention by first means, comprising a plurality of vanes forming a group of anode cavity resonators disposed like a ring, a microwave output port coupled with one of the plurality of vanes through an antenna, strap rings for electrically connecting alternate ones of the plurality of vanes only at axial ends of the plurality of vanes on the microwave output port side, a cathode positioned substantially at the center of a circle enveloping tips of the plurality of vanes, a pair of end shields provided at the two ends of the cathode, an annular interaction space extending axially between the cathode and the tips of the plurality of vanes to enclose the cathode, a pair of pole pieces positioned at the two axial ends of the interaction space to form an axial static magnetic field, permanent magnets positioned outside the axial ends of the two pole pieces, and a cathode stem supporting the cathode through heater-current-feeding wires, wherein the axial static magnetic field formed at one of the two axial ends of the interaction space is different from the one formed at the other end, and at least the interaction-side axial end of the peripheral portion of the end shield associated with the end corresponding to the weaker static magnetic field of the two axial ends of the interaction space is level with the axial ends of the plurality of vanes close to the cathode, or is displaced a predetermined distance axially toward the interaction space from the axial ends of the plurality of vanes.

Also, the foregoing objects are accomplished in accordance with aspects of the present invention by second means, comprising a plurality of vanes forming a group of anode cavity resonators disposed like a ring, a microwave output port coupled with one of the plurality of vanes through an antenna, strap rings for electrically connecting alternate ones of the plurality of vanes only at the axial ends of the plurality of vanes on the microwave output port side, a cathode positioned substantially at the center of a circle enveloping tips of the plurality of vanes, a pair of end shields provided at the ends of the cathode, an annular interaction space extending axially between the cathode and the tips of the plurality of vanes to enclose the cathode, a pair of pole pieces positioned at the axial ends of the interaction space to form an axial static magnetic field, permanent magnets positioned outside the two axial ends of the pair of pole pieces, and a cathode stem supporting the cathode through heater-current-feeding wires, wherein the static magnetic field in the interaction space at the axial end thereof on the microwave output port side is stronger than one at the axial end thereof on the cathode stem side.

BRIEF DESCRIPTION OF THE DRAWING

In the accompanying drawings, in which like parts bear like reference numerals:

FIG. 7(*b*) is a sectional view illustrating the anode cylinder illustrated in FIG. 7(*a*);

DETAILED DESCRIPTION OF THE PREFERRED EMBODIMENTS

Figure 1:
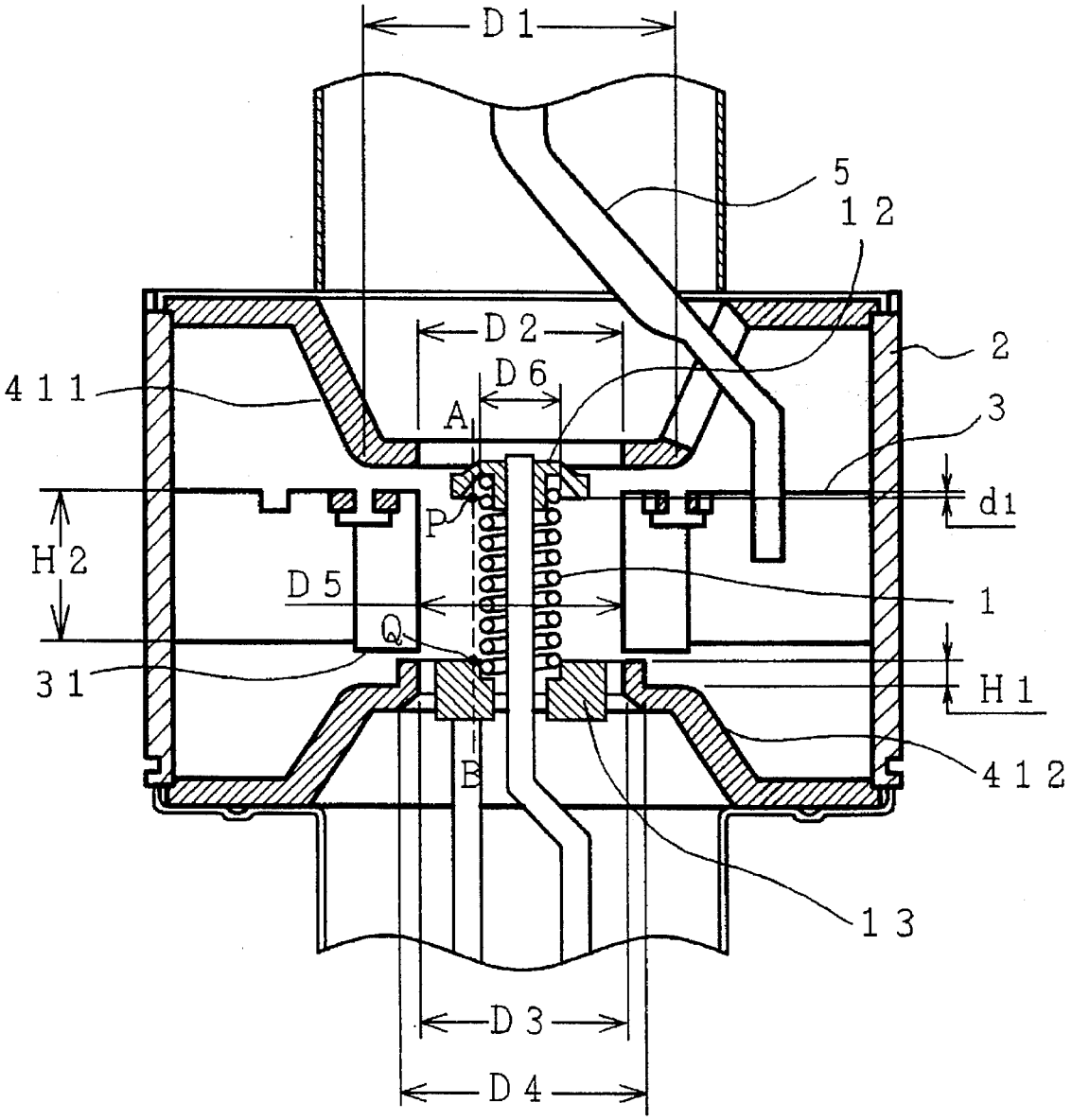
FIG. 1 is a sectional side view illustrating components, including an anode cylinder and pole pieces, that are main portions of a first embodiment of a magnetron according to the present invention.

The inventors have repeated trial fabrications and experiments of the magnetron having the above described anode cylinder by changing the distributions of magnetic fields and electric fields around the ends of the interaction space to reduce noises. As a result, they found that as in the first means described above, it is effective to make the static magnetic field formed by the pole piece on the cathode stem side different from the one formed at the microwave output port side to suppress side lobes and spurious signals in the frequency spectrum around the fundamental wave generated in the magnetron, thereby reducing radiation of noise.

Thermionic electrons emitted from a cathode filament make a circular motion in a plane perpendicular to the magnetic field. Radius R of the circle is given by Eq. 1 below.

$$R=(m/e)\times E/B^2 \quad \text{(Eq. 1)}$$

where m denotes the mass of an electron, which is $9.1\times10^{-31}$ kg, e is the charge of the electron, which is $-1.6\times10^{-19}$ C, E is the strength of the electric field, and B is the magnetic flux density.

As the magnetic field at the ends of the interaction space is generally weaker than the one at the center, the radius R at each end of the interaction space is larger. If the radius R is larger than a certain value, the thermionic electrons emitted from the filament strike the tips of the anode vanes or come out of the interaction space. This increases the dark current which causes the oscillation efficiency of the magnetron to be decreased. Increase of the dark current also is caused by eccentricity of an axis of the cathode. In an asymmetric magnetic field distribution, an end having a weaker magnetic field further increases the dark current. Therefore, one can make an anode construction such that a peripheral portion of the end shield on the weaker magnetic field side should be disposed inward beyond the tips of the vanes. The end shields can block the electrons with the peripheral portion so that the dark current can be prevented from increasing.

Alternatively, one can make an anode construction such that the peripheral portions of both the end shields should be disposed inward beyond the tips of the vanes. The electrons can be shielded by the peripheral portions of the end shields. This can suppress increase of the dark current irrespective of the magnetic field strengths produced by the pole pieces on both the sides. That is, one can change the shapes of the pole pieces on both the sides as desired without increasing the dark current. Also, in order to decrease noise in the magnetron having any of the above-mentioned anode constructions, the inventors have repeated trial fabrication and experiments of the magnetron having the above described anode cylinder by changing the distributions of magnetic fields and electric fields around the ends of the interaction space to reduce noises. As a result, they found that as in the second means described above, it is effective to make the static magnetic field due to the pole piece on the microwave output port side stronger than the field due to the pole piece on the cathode stem side to suppress side lobes and spurious signals in the frequency spectrum around the fundamental wave generated in the magnetron, thereby reducing radiation of noises.

Therefore, one can make a construction such that, as in the second means, the pole pieces can be shaped so that the side where the filament tends to be more eccentric, or the microwave output port side, should have a stronger magnetic field, thereby suppressing increase of the dark current as describe above.

With the constructions so far given, (1) the noises can be reduced by making asymmetric the magnetic field strengths at both ends of the interaction space with respect to each other, and (2) even if the cathode is tilted with one end of the heater-current-feeding wires for supporting the cathode fixed at the stem, the magnetic field on the side where the cathode tends to be more eccentric with respect to the tube axis, or the microwave output port side, can be made stronger than the one on the cathode stem side to suppress the increase in the dark current so that the oscillation efficiency of the magnetron can be increased.

It will be understood that the present invention is not limited to the specific embodiments having extended portions at the tips of the vanes hereinafter discussed.

Figure 8:
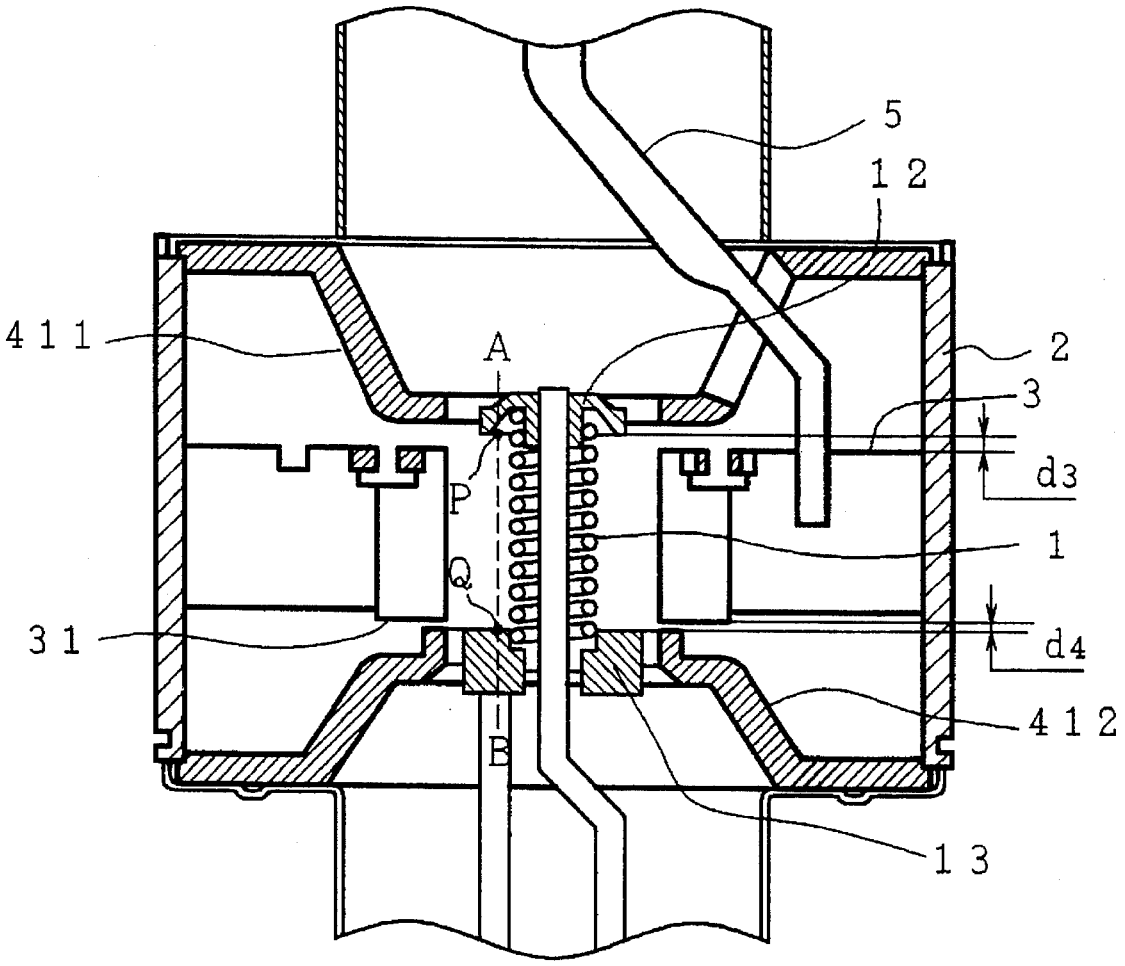
FIG. 8 is a sectional side view illustrating main portions, including an anode cylinder and pole pieces, of a magnetron in which as for intensities of static magnetic fields produced by pole pieces provided at both ends of a interaction space, the field provided by the pole piece on the microwave output port side is weaker than the field produced by the pole piece on a cathode stem side.
Figure 11:
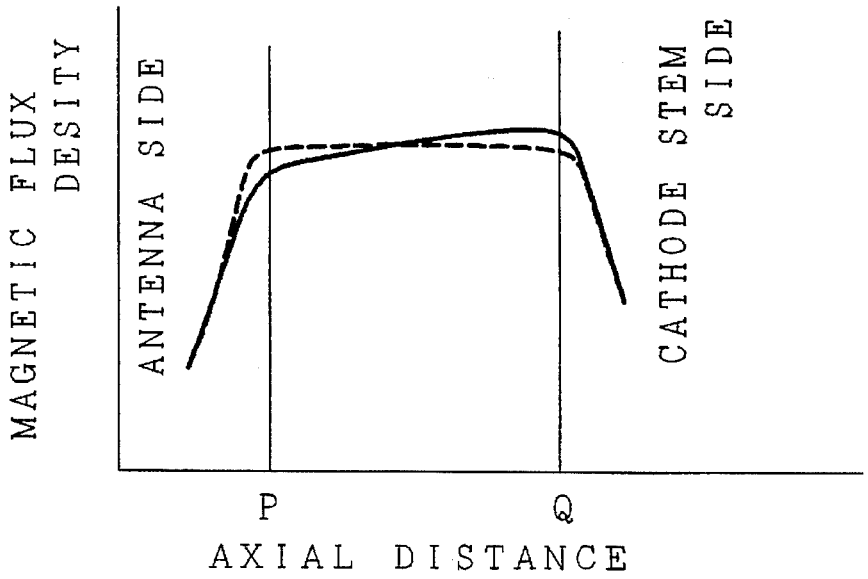
FIG. 11 is a graph illustrating a magnetic flux density distribution where an annular portion around a center hole of a pole piece closest to the axial ends of vanes on a microwave output port side is made flat.

FIG. 8 depicts a sectional side view illustrating an embodiment of a magnetron having a peripheral portion of a pole piece closest to ends of vanes on the microwave output port side made flat. The embodiment was devised and disclosed in the Japanese Patent Application No. 4-165689 by the inventors in advance of the present invention, but is not laid-open yet at the time of filing the present application. FIG. 11 depicts an axial magnetic flux density distribution on line A-B in FIG. 8. Line A-B is positioned substantially midway between the tips of the vanes and the axis of the cathode. The solid line in FIG.11 is a curve showing the axial magnetic flux density distribution on line A-B in FIG. 8 where an annular portion around a center hole of the pole piece closest to the axial ends of the vanes on the microwave output port side is flat. The broken line in FIG. 11 is a curve showing the axial magnetic flux density on line A-B where the shapes of portions of the upper and lower pole pieces closest to the axial ends of the vanes and facing an interaction space are identical.

Figure 9:
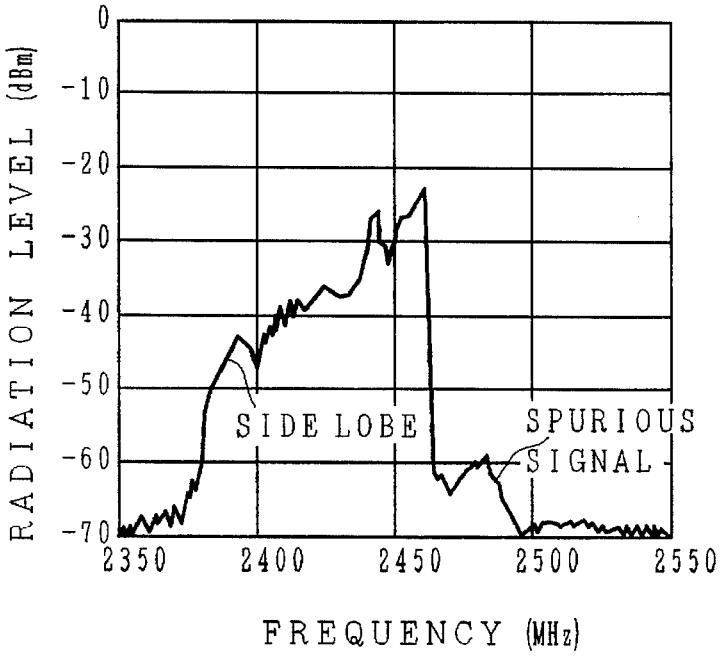
FIG. 9 (PRIOR ART)
FIG. 9 is a graph illustrating a spectrum around a fundamental frequency of 2,450 MHz of a prior art magnetron having strap rings provided only at one axial end of vanes.
Figure 10:
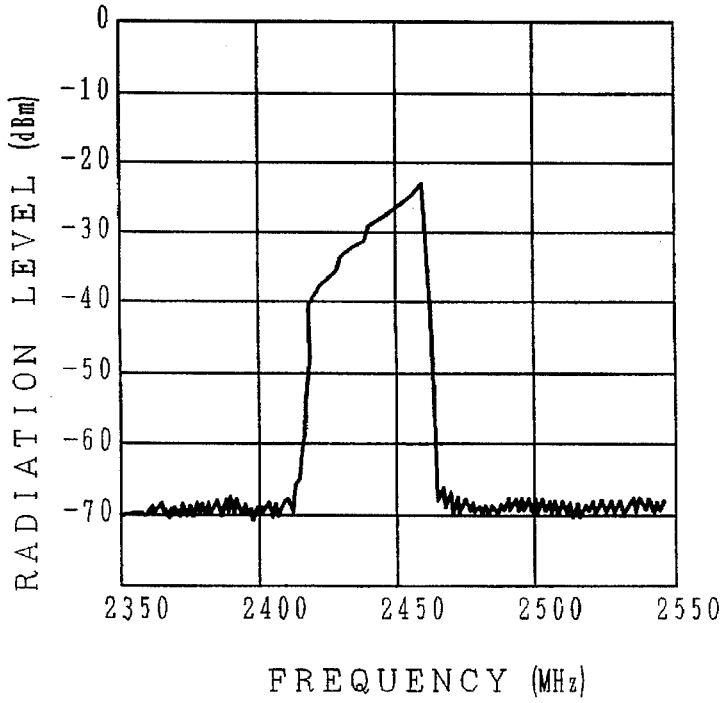
FIG. 10 is a graph illustrating a spectrum around a fundamental frequency of 2,450 MHz of a magnetron embodying the present invention.

In FIG. 8, the magnetron of the above proposal comprises a cathode 1, an anode cylinder 2, the vanes 3, a pole piece 11 mounted on the microwave output port side of the anode cylinder 2, a pole piece 412 mounted on the cathode stem side of the anode cylinder 2, and an antenna 5. A surface of the pole piece 411 closest to the axial ends of the vanes 3 is made flat as shown, while a surface of the pole piece 412 closest to the axial ends of the vanes 3 has a projecting portion. The upper end of the peripheral portion of lower end shield 13 is displaced a distance d4 from the interaction space with respect to the lower ends of the vanes 3. The frequency spectrum around a fundamental wave of this magnetron is shown in FIG. 10. The prior art magnetron, as shown in FIG. 9, has a frequency spectrum exceeding a frequency bandwidth of 2,450 plus or minus 50 MHz allotted to microwave apparatuses. To eliminate this, the microwave apparatuses have been devised to put the frequency spectrum within the allowed frequency bandwidth. The magnetron of the present invention has side lobes and spurious signals in the oscillation frequency spectrum thereby reduced to a great extent as shown in FIG. 10. This means that if the magnetron of the present invention is used in microwave apparatuses, such as a microwave oven, it is easy to suppress leakage of noises.

However, it is unavoidable that the cathode is tilted, or made eccentric with respect to the tube axis with one end of heater-current-feeding wires for supporting the cathode fixed on the stem during the mounting procedure of the cathode stem in assembling the magnetron. The amount of eccentricity of the cathode in FIG. 8, of course, is larger at point P close to an antenna than at point Q close to the stem.

If as shown in FIG. 8, a surface of the pole piece on the microwave output port side closest to the axial end of the vane is made flat, an axial magnetic flux density distribution on line A-B is as shown by the solid line in FIG. 11 and is low at point P. An interaction-space-side axial end of a peripheral portion of an end shield 12 on the microwave output port side is displaced axially a distance d3 (0.2 to 0.4 mm) from the axial ends of the vanes on the microwave output port side near the cathode, as shown in FIG. 8. The eccentricity of the cathode at point P therefore is so large that the dark current is increased. This decreases the oscillation efficiency of the magnetron.

FIG. 1 depicts a sectional view illustrating a first embodiment of a magnetron according to the present invention. The upper and lower pole pieces of the embodiment are of the same shape as in FIG. 8. The upper pole piece 411 has a flat surface closest to the axial end of the vanes.

The pole piece 411 is of the shape of a truncated-cone-like container formed of a flange of large diameter to be supported on an end of anode cylinder 2, a flat or gently curved bottom of small diameter having a opening at the center thereof that is concentric with the flange and spaced a certain distance from the flange which is of large diameter and a conical portion connecting the flange of large diameter with the bottom of small diameter. The pole piece 412 is of the shape of a truncated-cone-like container formed of a flange of large diameter to be supported on an end of anode cylinder 2, a flat or gently curved bottom of small diameter having an outwardly pointing annular lip at the center thereof that is concentric with the flange and spaced a certain distance from the flange of large diameter, and a conical portion connecting the flange of large diameter with the bottom of small diameter.

The axial magnetic flux density distribution on line A-B in FIG. 1 is as shown by the solid line in FIG. 11. Point P in FIGS. 11 and 12 denotes the intersection of the lower surface of the upper end shield with line A-B, and point Q denotes the intersection of the upper surface of the lower end shield with line A-B. As an actual example, the magnetic flux density midway of points P-Q was 1,700 gausses, and the difference in the magnetic flux density between points P and Q was 30 to 80 gausses. That is, between points P and Q there exists a difference of around 2 to 5% of the magnetic flux density at the center between points P and Q.

The lower end of the peripheral portion of the end shield 12, as shown in FIG. 1, is displaced a distance d1 toward the interaction space from the top of the vane 3. The distance d1 is 0 to 0.5 mm. In such a construction, electrons emitted from the cathode that otherwise pass point P having weak magnetic field in the interaction space are blocked by the lower end of the peripheral portion of the end shield 12. This can suppress increase of the dark current.

Examples of detailed dimensions in FIG. 1 are shown below.

The external dimension D1 of the bottom of the pole piece 411 is 18.00 mm. The diameter D2 of the center hole of the bottom of the pole piece 411 is 9.2 mm. The inside diameter D3 of the projected cylinder of the pole piece 412 is 9.2 mm. The outside diameter D4 of the projected cylinder of the pole piece 412 is 11.2 mm. The height H1 of the projected cylinder of the pole piece 412 is 1.0 mm. The diameter D5 of a circle of an envelope of tips of the vanes is 8.5 to 9.5 mm. The height H2 of the vane is 9.8 mm. The outside diameter D6 of the cathode is 5.0 mm.

The height Hi of the projected cylinder of the pole piece 412 can be 0.5 to 1.5 mm. The wall thickness of the projected cylinder in the radial direction thereof can be in the range of 0.5 to 1.5 mm, preferably 0.7 to 1.3 mm. If the projected cylinder is higher than that range, the oscillation efficiency may be too low or the oscillation made unstable. If the projected cylinder is lower than that range, on the other hand, the improvement effect of the oscillation spectrum may be reduced.

Figure 2:
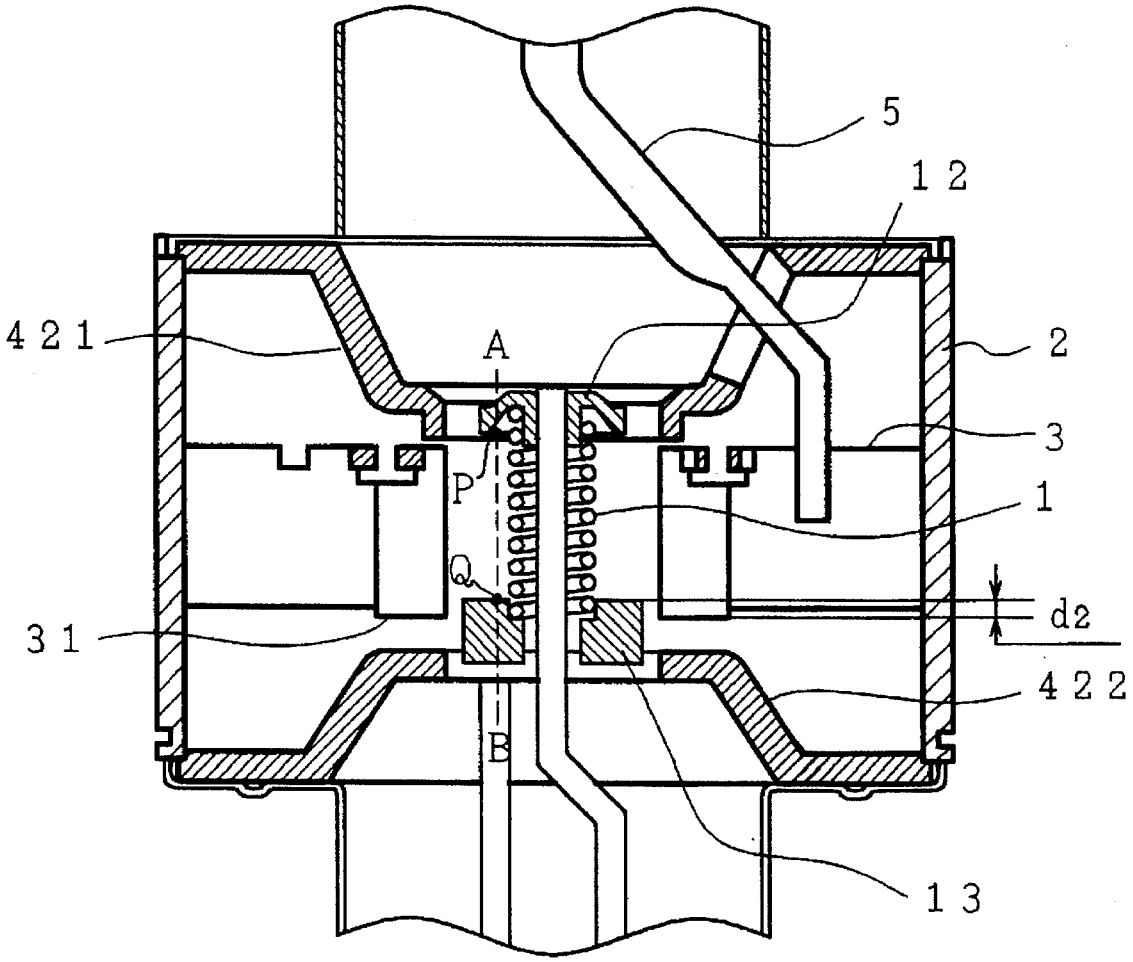
FIG. 2 is a sectional side view illustrating components, including an anode cylinder and pole pieces, that are main portions of a second embodiment of a magnetron according to the present invention.
Figure 3:
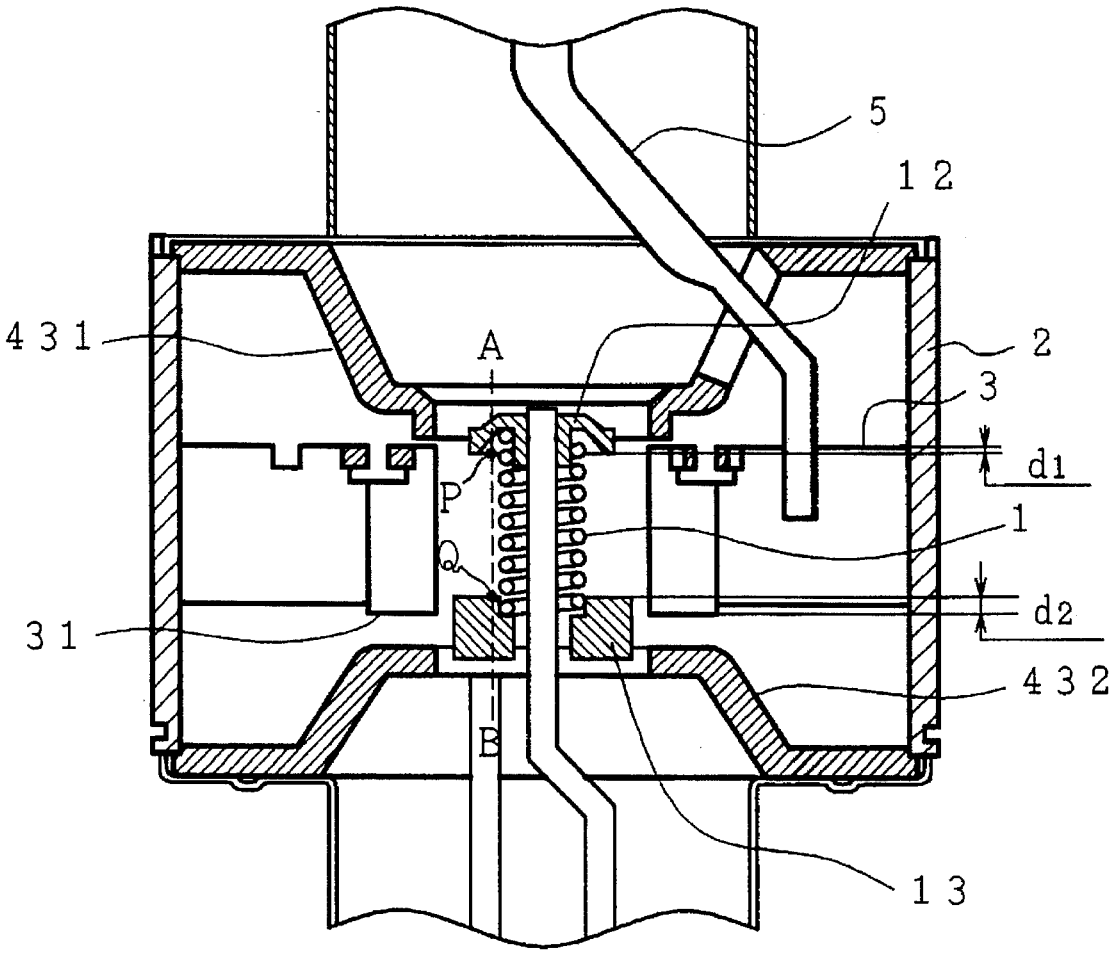
FIG. 3 is a sectional side view illustrating components, including an anode cylinder and pole pieces, that are main portions of a third embodiment of a magnetron according to the present invention.
Figure 4:
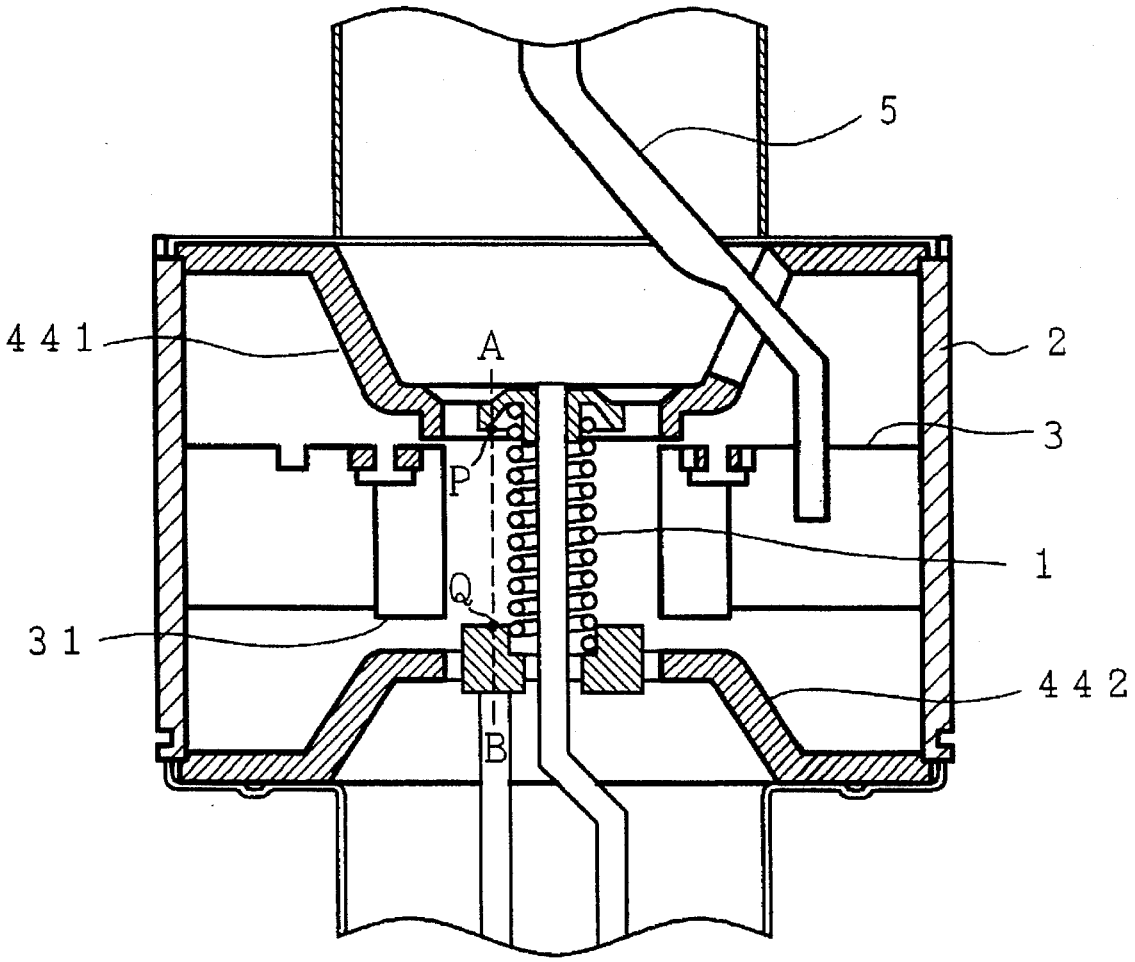
FIG. 4 is a sectional side view illustrating components, including an anode cylinder and pole pieces, that are main portions of a fourth embodiment of a magnetron according to the present invention.
Figure 5:
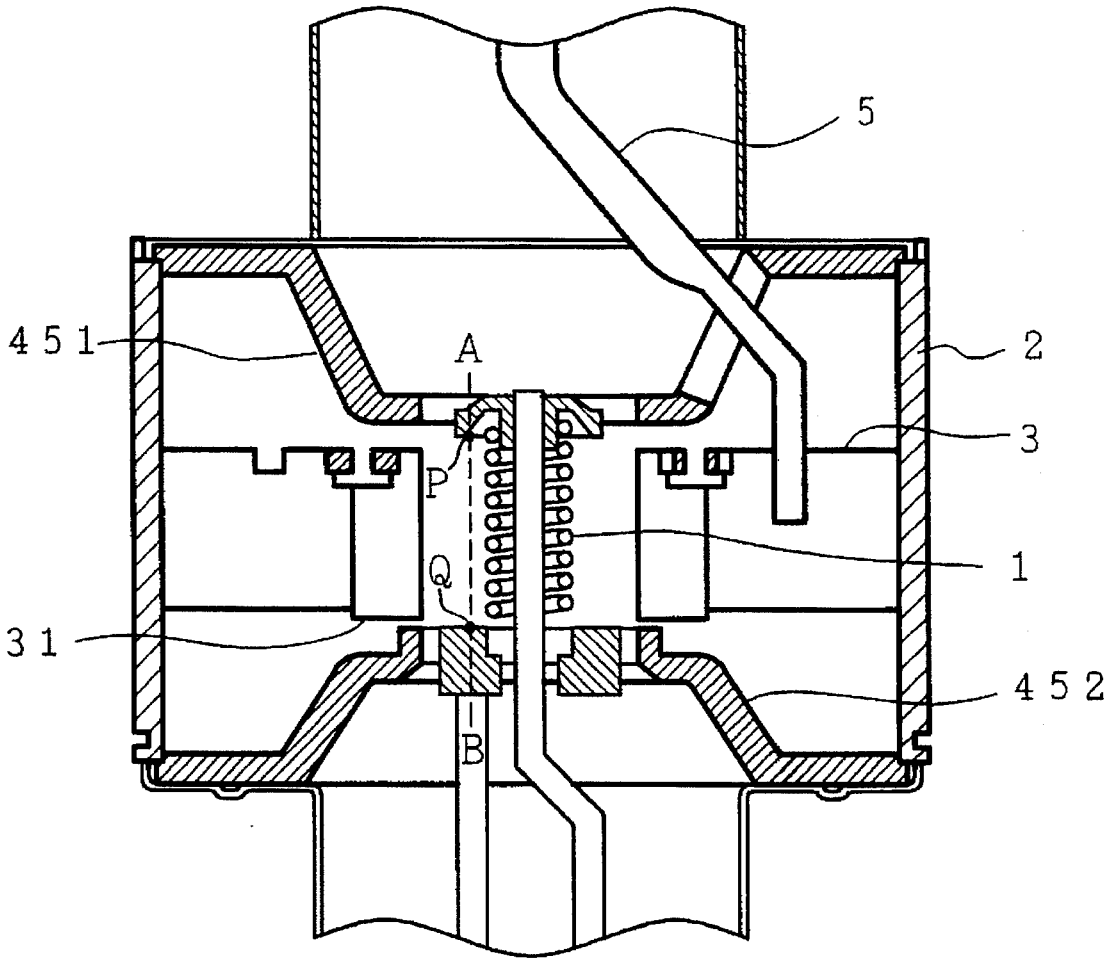
FIG. 5 is a sectional side view illustrating main portions, including an anode cylinder and pole pieces, of a magnetron in which as for intensities of static magnetic fields produced by pole pieces provided at both ends of a interaction space, the field produced by the pole piece on the microwave output port side is weaker than the one provided by the pole piece on the cathode stem side.
Figure 6:
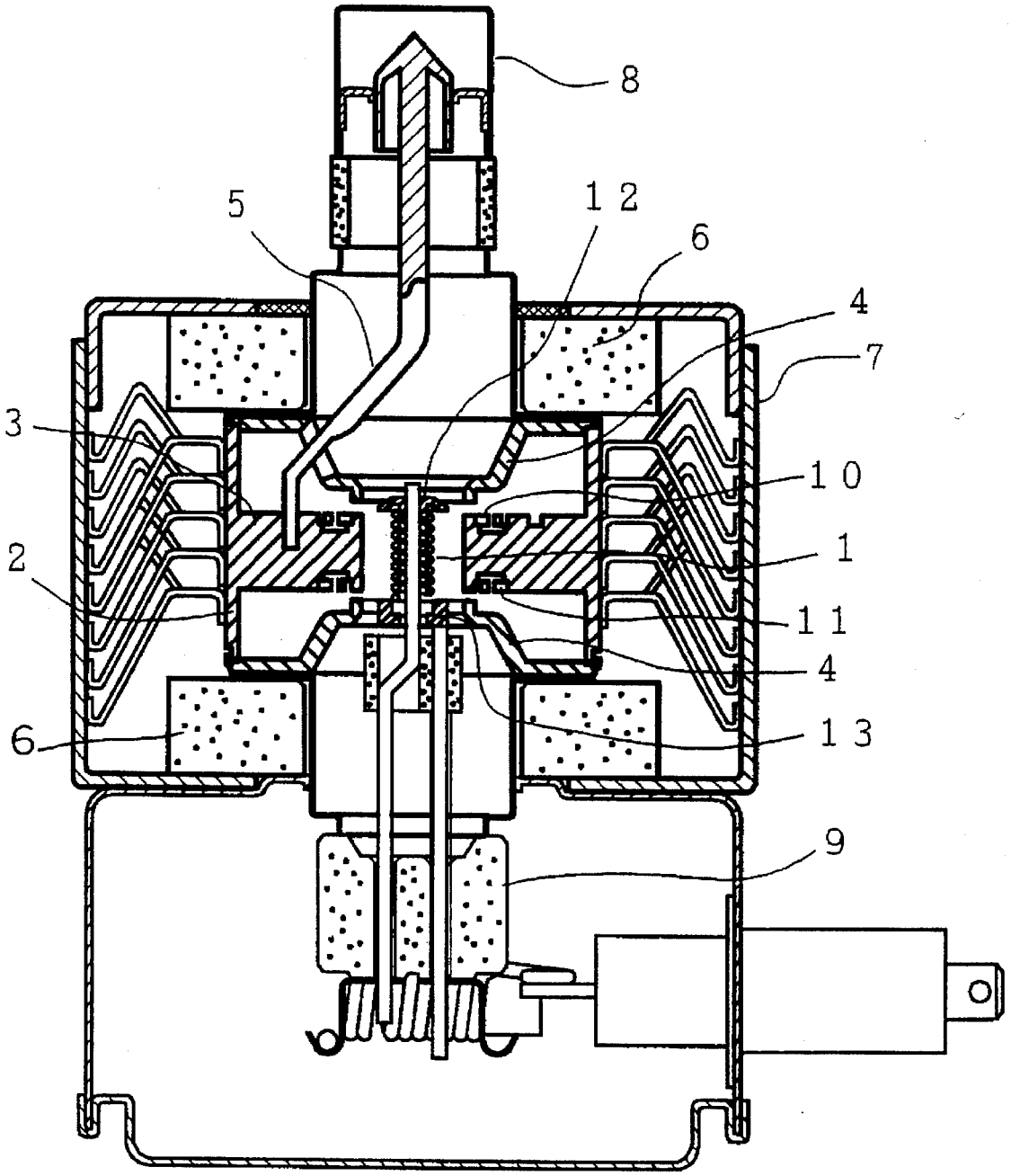
FIG. 6 (PRIOR ART)
FIG. 6 is a side view sectional in an axial direction of a tube illustrating an example of a prior art magnetron.
Figure 7:
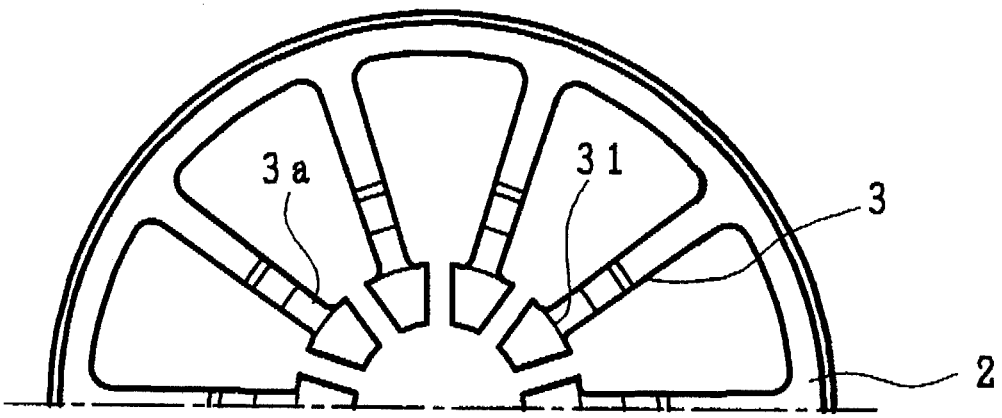
FIG. 7 (a) (PRIOR ART)
FIG. 7(*a*) is a plan view illustrating an anode cylinder of a magnetron in which strap rings are provided only at ends of vanes on the microwave output port side, and an end of each of vanes has a portion extended toward a tip of an adjacent vane, and a level difference is provided at a boundary between the extended portion and a portion adjoined with it to narrow the axial width of the portion of the vane other than the extended portion.
Figure 7:
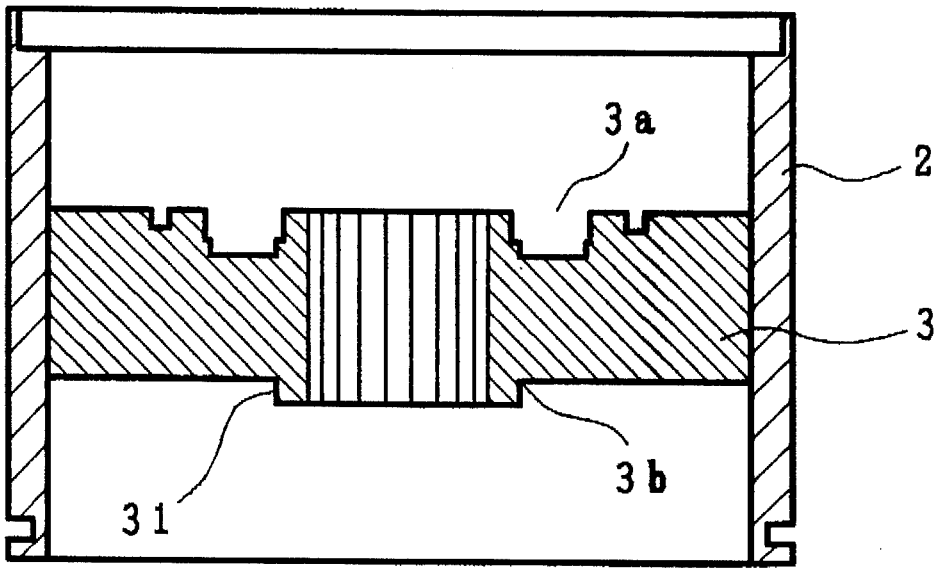
FIG. 7 (b) (PRIOR ART)

The above-mentioned shapes and dimensions of the pole pieces 411 and 412 are also used for pole pieces 422 and 421 in a second embodiment shown in FIG. 2, pole pieces 432 and 431 in a third embodiment shown in FIG. 3, pole pieces 442 and 441 in a fourth embodiment shown in FIG. 4, and pole pieces 452 and 451 in a fifth embodiment shown in FIG. 5.

Further, when 10 vanes form the group of anode cavity resonators, it is effective to make the axial length of the vanes longer than 9 mm when the diameter D5 of the circle of the envelope of the tips of the vanes is 8.5 to 9.5 mm. If the vanes have a shorter axial length than 9 mm, the oscillation efficiency may be too low or the oscillation tends to be unstable.

Figure 12:
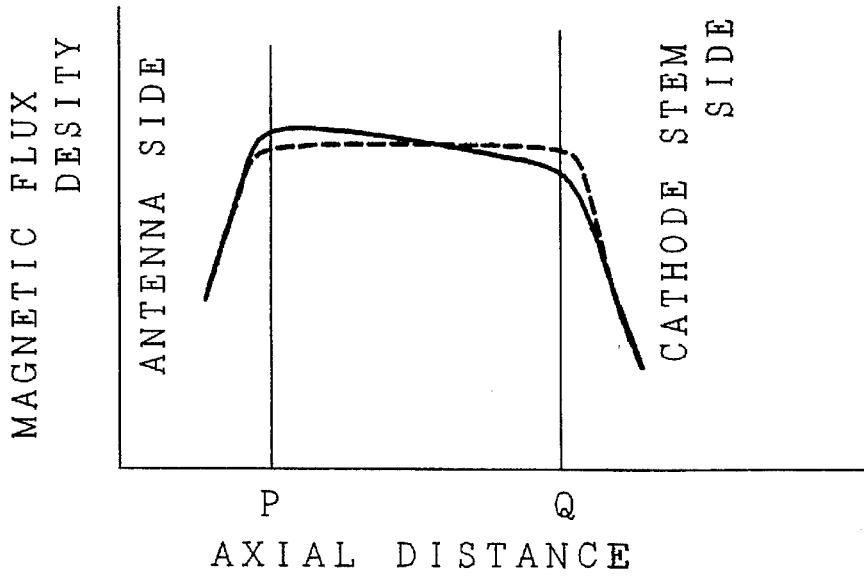
FIG. 12 is a graph illustrating a magnetic flux density distribution when an annular portion around a center hole of a pole piece closest to the axial ends of vanes on a cathode stem side are made flat.

FIG. 2 depicts a cross-sectional view illustrating a second embodiment of a magnetron according to the present invention. In the second embodiment, unlike the first embodiment in FIG. 1, a surface of the pole piece 422 closest to the axial ends of the vanes is made flat. FIG. 12 shows the axial magnetic flux density distribution on line A-B in FIG. 2. Line A-B is positioned substantially at a center line between the tips of the vanes and the axis of the cathode. The solid line in FIG. 12 is the curve showing the axial magnetic flux density distribution on line A-B in FIG. 2 when the annular portion around the center hole of the pole piece closest to the axial ends of the vanes on the cathode stem side is made flat. The broken line in the figure is a curve showing the axial magnetic flux density distribution on line A-B when the shapes of portions of the upper and lower pole pieces closest to the axial ends of the vanes and facing the interaction space are identical. As the surface of the lower pole piece 422 closest to the axial ends of the vanes in the embodiment is flat, the magnetic field at point Q is weakened, the top end of the peripheral portion of the lower end shield 13 is displaced a distance d2 toward the interaction space from the lower ends of the vanes 3. Distance d2 should be in the range of 0 to 0.5 mm. In such a construction, electrons emitted from the cathode that otherwise pass point Q of weak magnetic flux density in the interaction space are blocked by the upper ends of the peripheral portion of the lower end shield 13. This can suppress increase of the dark current.

FIG. 3 depicts a sectional view illustrating a third embodiment of a magnetron according to the present invention. The interaction-space-side axial ends of the peripheral portion of the upper and lower end shields 12 and 13 are displaced axially by distances d1, d2, respectively, toward the interaction space from the axial ends of the vanes 3 closest to the cathode irrespective of the shape of the pole pieces 431 and 432. Distances d1 and d2 should be in the range of 0 to 0.5 mm. In such a construction, electrons emitted from the cathode that otherwise pass point P or Q of weak magnetic flux density in the interaction space are blocked by the lower end of the peripheral portion of the upper end shield 12 or the upper end of the peripheral portion of the lower end shield 13. This can suppress increase of the dark current.

The shapes of the interaction-space-side axial ends of the upper and lower pole pieces closest to the tips of the vanes change the magnetic flux density at points P and Q, thereby influencing the increase in dark current. But, in the embodiment one can select the shape of the axial end portion of the upper and lower pole pieces as desired without increasing the dark current. This means that the static magnetic flux density distribution produced by the upper and lower pole pieces can be optimized. Hence, one can easily take measures against noise leakage, thereby reducing the noise level.

It should be noted that if distance d1 or d2 is set to be more than 0.5 mm toward the interaction space, the π-mode oscillation cannot be stable.

FIG. 4 depicts a sectional side view illustrating an anode cylinder and pole pieces that are main parts in a fourth embodiment of a magnetron according to the present invention. In the figure, the magnetron comprises a cathode 1, an anode cylinder 2, vanes 3, a pole piece 441 mounted on the microwave output port side of the anode cylinder 2, a pole piece 442 mounted on the cathode stem side of the anode cylinder 2, and an antenna 5. The surface of the pole piece 442 closest to the axial ends of the vanes 3 is flat as shown, while the surface of the pole piece 441 closest to the axial ends of the vanes 3 has a projecting cylinder. The frequency spectrum around a fundamental wave of the magnetron is shown in FIG. 10. The prior art magnetron, as shown in FIG. 9, has a frequency spectrum with a frequency bandwidth exceeding the 2,450 plus or minus 50 MHz allotted to microwave apparatuses. To prevent this, microwave apparatuses have been devised to control the frequency spectrum within the allowable frequency bandwidth. The magnetron of the present invention has side lobes and spurious signals in oscillation frequency spectrum reduced to a great extent as shown in FIG. 10. This means that if the magnetron of the present invention is used in microwave apparatuses, such as a microwave oven, it is easy to suppress leakage of noise.

As described above, the magnetic flux densities at both the ends in the interaction space should be asymmetric so that noise leakage can easily be reduced. If the magnetic field distribution is reversed from the one shown in FIG. 4, however, a problem may arise, since a large eccentricity of a cathode can cause an increase in dark current, which in turn can decrease the oscillation efficiency of the magnetron, as described hereinafter.

FIG. 5 depicts a sectional view illustrating a fifth embodiment of a magnetron according to the present invention. The fifth embodiment has a flat annular portion around the center hole of the pole piece closest to the axial ends of the vanes on the microwave output port side. The surface of the pole piece 451 closest to the axial ends of the vanes 3 on the output side is flat as shown, while the surface of the pole piece 452 closest to the other axial ends of the vanes 3 has a projecting cylinder. FIG. 11 shows the axial magnetic flux density distribution on line A-B in FIG. 5. FIG. 12 shows the axial magnetic flux density distribution on line A-B in FIG. 4. Line A-B is positioned substantially at a center line between the tips of the vanes and the axis of the cathode. The solid line in FIG. 11 is a curve showing the axial magnetic flux density distribution on line A-B in FIG. 5 when an annular portion around the center hole of the pole piece closest to the axial ends of the vanes on the microwave output port side is flat. The solid line in FIG. 12 is a curve showing the axial magnetic flux density distribution on line A-B in FIG. 4 when an annular portion around the center hole of the pole piece closest to the axial ends of the vanes on the cathode stem side is flat. Point P in FIGS. 11 and 12 denotes the intersection of the lower surface of the upper end shield with line A-B, and point Q denotes the intersection of the upper surface of the lower end shield with line A-B. As an actual example, the magnetic flux density at the center position of line P-Q was 1,700 gausses, and the difference in the magnetic flux density between points P and Q was in the range of 30 to 80 gausses. That is, a difference of around 2 to 5% of the magnetic flux density at the center position exists between points P and Q.

Each of broken lines in FIGS. 11 and 12 is a curve of showing the axial magnetic flux densities on line A-B when the shapes of portions of the upper and lower pole pieces closest to the axial ends of the vanes and facing the interaction space are identical.

It is unavoidable that the cathode is tilted, or made eccentric with respect to the tube axis with one end of heater-current-feeding wires for supporting the cathode fixed on the stem during the mounting procedure of the cathode stem in assembling the magnetron. Eccentricity of the cathode, of course, is larger at point P which is closest to an antenna than at point Q which is closest to the cathode stem.

If as shown in FIG. 5, the surface of the pole piece on the microwave output port side that is closest to the axial ends of the vanes is flat, an axial magnetic flux density distribution on line A-B is as shown by a solid line in FIG. 11 and the magnetic flux density is low at point P. If the eccentricity of the cathode at point P is large, the dark current increases. This decreases the oscillation efficiency of the magnetron.

In the fourth embodiment of the present invention shown in FIG. 4, the axial magnetic flux density distribution on line A-B is as shown with a solid line in FIG. 12. As the magnetic flux density at point P is high, the increase in the dark current can be suppressed even if eccentricity of the cathode is large at that point. The oscillation efficiency of the magnetron therefore can be increased.

As described above, the present invention can easily reduce leakage of noise waves and suppress increase in dark current to increase the oscillation efficiency of the magnetron. Further, as one can select the shapes of the portions of the pole pieces facing the interaction space that are closest to the axial ends of the vanes as desired, the static magnetic flux density distribution produced by the upper and lower pole pieces can be optimized, thereby further reducing the noise level.

What is claimed is:

1. A magnetron, comprising:

an anode cylinder, a plurality of vanes extending radially inwardly from said anode cylinder and thereby defining a group of anode cavity resonators, an antenna, means defining a microwave output port disposed in axially spaced relationship from said plurality of vanes and coupled with one of said plurality of vanes through said antenna, strap rings electrically connecting alternate ones of said plurality of vanes only at axial ends of said plurality of vanes on the microwave output port side thereof, a cathode positioned substantially at the center of a circle enveloping tips of said plurality of vanes and cooperating with said tips of said plurality of vanes to define an annular interaction space extending between said cathode and said tips and encircling said cathode, a pair of end shields provided at two opposite ends of said cathode, a pair of pole pieces positioned at two axial ends of the interaction space for shaping an axial static magnetic field produced therein, a pair of permanent magnets positioned outside said pair of pole pieces and outside said anode cylinder, and a cathode stem for supporting said cathode through heater-current-feeding wires, wherein:

an axial static magnetic field resulting from said pair of permanent magnets and existing in a plane containing an inner surface of the one of said pair of end shields on said microwave output port side in the interaction space is different from a static magnetic field existing in a plane containing an inner surface of the one of said pair of end shields on said cathode stem side in the interaction space, and at least an interaction-space-side axial end of a peripheral portion of said end shield associated with the end of the interaction space corresponding to the weaker static magnetic field of said two axial magnetic fields in said interaction space is displaced a predetermined distance d axially toward said interaction space from said axial ends of said plurality of vanes and close to said cathode, where d is equal to or greater than zero.

2. The magnetron according to claim 1, wherein said end of said interaction space corresponding to said weaker static magnetic field is disposed at said axial ends of said plurality of vanes on said microwave output port side.

3. The magnetron according to claim 2, wherein said predetermined distanced is not longer than 0.5 mm.

4. The magnetron according to claim 1, wherein one of said pair of pole pieces is shaped like an inverted truncated cone with a substantially flat bottom and with an aperture at the center of said bottom, and said bottom faces said axial ends of said plurality of vanes on said microwave output port side to produce said weaker static magnetic field.

5. The magnetron according to claim 4, wherein the other of said pair of pole pieces is shaped like an inverted truncated cone with an outwardly pointing annular lip at the center of a smaller diameter end thereof, and said annular lip faces said axial ends of said plurality of vanes on said cathode stem side.

6. The magnetron according to claim 1, wherein one of said pair of pole pieces is shaped like an inverted truncated cone with a substantially flat bottom and with an aperture at the center of said bottom, and said bottom faces said axial ends of said plurality of vanes on said cathode stem side to produce said weaker static magnetic field.

7. The magnetron according to claim 6, wherein the other of said pair of pole pieces is shaped like an inverted truncated cone with an outwardly pointing annular lip at the center of a smaller diameter end thereof, said annular lip faces said axial ends of said plurality of vanes on said microwave output port side.

8. The magnetron according to claim 1, wherein said predetermined distanced is not longer than 0.5 mm.

9. The magnetron according to claim 1, wherein said end of said interaction space corresponding to said weaker static magnetic field is disposed at said axial ends of said plurality of vanes on said cathode stem side.

10. The magnetron according to claim 9, wherein said predetermined distanced is not longer than 0.5 mm.

11. The magnetron according to claim 1, wherein interaction-space-side axial ends of peripheral portions of both of said pair of end shields are displaced the predetermined distance d axially toward said interaction space from said axial ends of said plurality of vanes and close to said cathode.

12. The magnetron according to claim 1, wherein said plurality of vanes comprise ten vanes, and the axial height of said vanes is not less than 9 mm.

13. The magnetron according to claim 1, wherein said cathode is a cylindrical cathode, and the difference between the axial magnetic flux density at the intersection of a line passing midway between said tips of said plurality of vanes and the axis of the cylindrical cathode and in parallel with said axis of said cylindrical cathode with the inner surface of one of said pair of end shields on said microwave output port side and the axial magnetic flux density at the intersection of said line with the inner surface of the other of said pair of end shields on said cathode stem side is 30 to 80 gausses.

14. The magnetron according to claim 1, wherein said cathode is a cylindrical cathode, and the difference in the axial magnetic flux density at the intersection of a line passing midway between said tips of said plurality of vanes and the axis of the cylindrical cathode and in parallel with said axis of said cylindrical cathode with the inner surface of one of said pair of end shields on said microwave output port side and the axial magnetic flux density at the intersection of said line with the inner surface of the other of said pair of end shields on said cathode stem side is in the range of 2 to 5% of the magnetic flux density at the center point of said line between said intersections.

15. A magnetron, comprising:

an anode cylinder, a plurality of vanes extending radially inwardly from said anode cylinder and thereby defining a group of anode cavity resonators, an antenna, means defining a microwave output port disposed in axially spaced relationship from said plurality of vanes and coupled with one of said plurality of vanes through said antenna, strap rings electrically connecting alternate ones of said plurality of vanes only at axial ends of said plurality of vanes on the microwave output port side thereof, a cathode positioned substantially at the center of a circle enveloping tips of said plurality of vanes and cooperating with said tips of said plurality of vanes to define an annular interaction space extending between said cathode and said tips and encircling said cathode, a pair of end shields provided at two opposite ends of said cathode, a pair of pole pieces positioned at two axial ends of the interaction space for shaping an axial static magnetic field produced therein, a pair of permanent magnets positioned outside said pair of pole pieces and outside said anode cylinder, and a cathode stem for supporting said cathode through heater-current-feeding wires, wherein:

an axial static magnetic field, resulting from said pair of permanent magnets and existing in a plane containing an inner surface of the one of said pair of end shields on said microwave output port side in the interaction space is stronger than a static magnetic field existing in a plane containing an inner surface of the one of said pair of end shields on said cathode stem side in the interaction space.

16. The magnetron according to claim 15, wherein said plurality of vanes comprise ten vanes, and the axial height of said vanes is not less than 9 mm.

17. The magnetron according to claim 15, wherein the one of said pair of pole pieces positioned on said microwave output port side is shaped like an inverted truncated cone with an outwardly pointing annular lip at the center of a smaller diameter end thereof, and said annular lip faces said axial ends of said plurality of vanes on said magnetron output port side.

18. The magnetron according to claim 17, wherein the other of said pair of pole pieces is shaped like an inverted truncated cone with a substantially flat bottom and with an aperture at the center of said bottom, and said bottom faces said axial ends of said plurality of vanes on said cathode stem side.

19. The magnetron according to claim 15, wherein said cathode is a cylindrical cathode, and the difference between the axial magnetic flux density at the intersection of a line passing midway between said tips of said plurality of vanes and the axis of the cylindrical cathode and in parallel with said axis of said cylindrical cathode with the inner surface of one of said pair of end shields on said microwave output port side and the axial magnetic flux density at the intersection of said line with the inner surface of the other of said pair of end shields on said cathode stem side is 30 to 80 gausses.

20. The magnetron according to claim 15, wherein said cathode is a cylindrical cathode, and the difference in the axial magnetic flux density at the intersection of a line passing midway between said tips of said plurality of vanes and the axis of the cylindrical cathode and in parallel with said axis of said cylindrical cathode with the inner surface of one of said pair of end shields on said microwave output port side and the axial magnetic flux density at the intersection of said line with the inner surface of the other of said pair of end shields on said cathode stem side is in the range of 2 to 5% of the magnetic flux density at the center point of said line between said intersections.

* * * * *